US006029450A

United States Patent [19]

Wittich

[11] Patent Number: 6,029,450

[45] Date of Patent: Feb. 29, 2000

[54] HYDRAULIC SYNCHRONIZING CIRCUIT

[75] Inventor: Kurt Wittich, Bebra, Germany

[73] Assignee: Hyco Pacoma GmbH, Eschwege, Germany

[21] Appl. No.: 09/207,365

[22] Filed: Dec. 8, 1998

[30] Foreign Application Priority Data

Dec. 10, 1997 [DE] Germany ..... 197 54 883

[51] Int. Cl.[7] ..... F15B 7/00

[52] U.S. Cl. ..... 60/571; 91/171; 91/189 R

[58] Field of Search ..... 60/397, 571, 581; 91/171, 189 R

[56] References Cited

U.S. PATENT DOCUMENTS

| | | | |
|---|---|---|---|
| 3,752,039 | 8/1973 | Hewins | 91/171 |
| 4,343,226 | 8/1982 | Almeida | 91/171 |
| 5,072,649 | 12/1991 | Laghi | 91/171 |

FOREIGN PATENT DOCUMENTS 2186637 1/1987 United Kingdom .

*Primary Examiner*—Hoang Nguyen
*Attorney, Agent, or Firm*—Womble Carlyle Sandridge & Rice

[57] ABSTRACT

A hydraulic synchronizing circuit includes at least one master cylinder unit including a primary chamber, a secondary chamber, a piston and at least one piston rod, the piston having a primary effective surface and a secondary effective surface. The hydraulic synchronizing circuit further includes at least one slave cylinder unit including a primary chamber, a secondary chamber, a piston and at least one piston rod, the piston having a primary effective surface and a secondary effective surface. The master cylinder unit and the slave cylinder unit are arranged to be single-acting. The secondary effective surface of the master cylinder unit and the primary effective surface of the slave cylinder unit are substantially equal. A tank at least partially formed by the secondary chamber of the slave cylinder unit and containing a fluid is provided. A pump sucks the fluid from the tank. A first conduit operatively connects the tank to the primary chamber of the master cylinder unit via the pump. A second conduit operatively connects the secondary chamber of the master cylinder unit to the primary chamber of the salve cylinder unit.

11 Claims, 4 Drawing Sheets

HYDRAULIC SYNCHRONIZING CIRCUIT

FIELD OF THE INVENTION

The present invention generally relates to a hydraulic synchronizing circuit including at least one master cylinder unit and at least one slave cylinder unit. More particularly, the present invention relates to a synchronizing circuit that is capable of moving an element uniformly by a number of cylinders. The invention is for example applicable for working platforms, for example hydraulic car lifts in garages.

BACKGROUND OF THE INVENTION

Hydraulic synchronizing circuits are commonly known. Usually, one master cylinder unit and one slave cylinder unit are used. Each cylinder includes a piston connected to a piston rod extending through the primary chamber of the cylinder, so that the master cylinder unit and the slave cylinder unit work in a pulling manner. The diameter of the slave cylinder unit is slightly bigger than the diameter of the master cylinder unit, as it corresponds to the surface of the piston rod of the slave cylinder unit. A pump is provided which sucks in hydraulic medium and pumps the hydraulic medium into the primary chamber of the master cylinder unit via a control valve. The secondary chamber of the slave cylinder unit is connected to atmosphere to prevent compression inside the secondary chamber of the slave cylinder unit in case of an activation of the synchronizing unit. The master cylinder unit and the slave cylinder unit are arranged single-acting. Single-acting means that a return movement of the cylinders only results from external forces. A control valve has a position in which it enables the hydraulic medium to flow back into the tank from the primary chamber of the master cylinder unit. The two cylinders are connected in series by the second conduit connecting the secondary chamber of the master cylinder unit to the primary chamber of the slave cylinder unit.

Another hydraulic synchronizing circuit is known in which two identical cylinders are used. The cylinders each include two identical piston rods of identical diameters on both sides of their piston. The master cylinder unit is connected in series to the slave cylinder unit. The secondary chamber of the master cylinder unit is connected to the primary chamber of the slave cylinder unit by the second conduit. The secondary chamber of the slave cylinder unit is not connected to the atmosphere. A return conduit is provided which leads back to the tank via the control valve.

It is disadvantages in both synchronizing circuits that, in any case, a separate tank has to be provided. The dimensions of the tank have to chosen so that the tank is capable of at least holding the volume of the fluid to be pumped into the primary chamber of the master cylinder unit to attain the maximum stroke. When the cylinders have identical piston rods on both sides of their piston, the tank can generally be designed smaller since hydraulic medium is pumped back into the tank from the secondary chamber of the slave cylinder unit each time the cylinder is activated. Nevertheless, the separate arrangement after tank is an additional constructive requirement which is costly. Additionally, cylinders having piston rods on both sides of there piston are more complicated and more expensive.

SUMMARY OF THE INVENTION

Briefly described, the present invention provides a hydraulic synchronizing circuit for moving an element uniformly by a number of cylinders. The hydraulic synchronizing circuit includes at least one master cylinder unit including a primary chamber, a secondary chamber, a piston and at least one piston rod, the piston having a primary effective surface and a secondary effective surface. The hydraulic synchronizing circuit includes at least one slave cylinder unit including a primary chamber, a secondary chamber, a piston and at least one piston rod, the piston having a primary effective surface and a secondary effective surface. The master cylinder unit and the slave cylinder unit are arranged to be single-acting. The secondary effective surface of the master cylinder unit and the primary effective surface of the slave cylinder unit are substantially equal. A tank at least partially formed by the secondary chamber of the slave cylinder unit and containing a fluid is provided. A pump sucks the fluid from the tank. A first conduit operatively connects the tank to the primary chamber of the master cylinder unit via the pump. A second conduit operatively connects the secondary chamber of the master cylinder unit to the primary chamber of the salve cylinder unit. Such a hydraulic synchronizing circuit may also include more than two cylinders, whereby at least one master cylinder unit and one slave cylinder unit are provided. It is the task of the synchronizing circuit to operate the cylinders by only one pump, and to attain the same stroke at the same time. Hydraulic mediums or fluids are almost incompressible. This feature is used to design the effective surface of the secondary chamber of the master cylinder unit and the effective surface of the primary chamber of the slave cylinder unit with identical dimensions, and to connect them to one another, so that the slave cylinder unit follows the master cylinder unit with the identical stroke. Such hydraulic synchronizing circuits are especially used for working platforms, for example hydraulic car lifts in garages, but also for other purposes. They are generally required when one element has to be uniformly moved by several cylinders.

The present invention starts from the idea to use the secondary chamber of the slave cylinder unit more effectively than in the prior art. For this reason, the secondary chamber of the slave cylinder unit is no longer exclusively connected to the atmosphere, but it also serves to hold the hydraulic medium or fluid. The secondary chamber of the slave cylinder unit can replace the separate tank known from the prior art totally or at least partly. Since the secondary chamber of the slave cylinder unit is not used for hydraulic medium in the prior art but is vented instead, this secondary chamber is now used to hold the hydraulic medium. The secondary chamber of the slave cylinder unit can be freely chosen extending from the cylinder stroke independent of all other structural requirements of the master cylinder unit and of the slave cylinder unit. For example, the secondary chamber of the slave cylinder unit can be designed longer than the secondary chamber of the master cylinder unit. For example, it is also possible to expand the diameter of the extended part to attain a greater volume which is partly filled with hydraulic medium. The region above the level of the hydraulic medium is connected to the atmosphere. Thus, the secondary chamber of the slave cylinder unit is connected to the atmosphere in all cases. The pump may suck in hydraulic medium directly from the secondary chamber. The suction pipe is designed and ranged to remain below the level of the hydraulic medium during traveling along the maximum stroke of the two cylinders. The invention can also be partly realized by providing only a portion of the necessary tank volume inside the secondary chamber of the slave cylinder unit. In this case, the secondary chamber of the slave cylinder unit is connected to an auxiliary tank holding a relatively small volume via a conduit. The pump sucks from this auxiliary tank. Preferably, the entire necessary volume of the tank is located inside the secondary chamber of the slave cylinder unit, instead of providing an auxiliary tank. It has to be considered whether the level of the hydraulic medium rises or falls during the travel through the maximum stroke. This depends from the fact whether a pulling or a pushing arrangement of the piston rod of the master cylinder unit and of the slave cylinder unit is used.

The tank located in the secondary chamber of the slave cylinder unit has to be designed and arranged to contain at least a volume necessary for a complete stroke of the piston of the master cylinder unit, and additionally a difference volume of the complete stroke of the piston and a difference between the secondary effective surface of the slave cylinder unit and the primary effective surface of the master cylinder unit. Additionally, a safety volume has to be considered to compensate thermal expansion volumes or leakage loss. On the other hand, the end of the suction pipe of the pump has to be located to always remain below the level of the hydraulic medium during travel along the maximum stroke, so that the pump always sucks in hydraulic medium. The changing level of the hydraulic medium inside the secondary chamber of the slave cylinder unit has to be considered. The suction pipe of the pump and the piston of the slave cylinder unit may not interfere with each other during travel through the maximum stroke.

There are different possible constructions using the secondary chamber of the slave cylinder unit as a tank. The slave cylinder unit may have a greater length than the master cylinder unit. In this case, the master cylinder unit determines the maximum stroke, i.e. the maximum permissible stroke and the wanted stroke, respectively, of the master cylinder unit at the same time limits the maximum stroke of the slave cylinder unit. It is also possible to provide a stroke limitation which is either arranged inside the master cylinder unit or inside the slave cylinder unit to determine the maximum permissible stroke of the two cylinders. Another possible construction concerning the volume of the secondary chamber of the slave cylinder unit includes a step having a comparatively greater diameter located at the slave cylinder unit on the secondary site adjacent to the full stroke. It is to be understood that the piston of the slave cylinder unit never reaches the region having the comparatively greater diameter. In both constructions, there is the advantage of easily designing the volume of the secondary chamber of the slave cylinder unit not to have the requirement of using an additional auxiliary tank. But it is also possible that an auxiliary tank is arranged in the conduit between the secondary chamber of the slave cylinder unit forming the tank and the pump. The auxiliary tank only has to be able to hold a relatively small volume. In this case, the master cylinder unit and the slave cylinder unit may have the same length. In case of both cylinders each having two identical piston rods, the cylinders may be identical. Anyway, the secondary chamber of the slave cylinder unit is used as the tank by the volume of the secondary chamber forming a part of the tank from which the pump sucks.

A pushing arrangement is provided when the piston rods of the master cylinder unit and of the slave cylinder unit each extend through their corresponding chamber. The piston rod of the slave cylinder unit extends to the secondary chamber, and the level of the hydraulic medium falls inside the secondary chamber when the stroke rises or goes up. The secondary chamber has to be designed great enough, so that the level does not fall below the suction pipe of the pump when the maximum stroke is reached.

A pulling arrangement is provided when the piston rods of the master cylinder unit and after slave cylinder unit each extend through their corresponding primary chamber. The level of the hydraulic medium inside the secondary chamber of the slave cylinder unit rises from the starting point up to the maximum stroke when the stroke rises. In this case, rising of the level has to be possible without the secondary chamber being connected to the atmosphere overflowing.

These precautions are not necessary when the master cylinder unit and the slave cylinder unit are designed to each include two identical piston rods. In this case, the level of the hydraulic medium inside the secondary chamber of the slave cylinder unit does not change.

Usually, the secondary chamber of the slave cylinder unit forming the tank includes a venting device, or is connected to a bubble reservoir or membrane reservoir filled with a gas. The use of a reservoir makes it possible to bias the system with a certain starting pressure.

The present invention is also related to a slave cylinder unit for a hydraulic synchronizing circuit. The slave cylinder unit includes a primary chamber, a secondary chamber, a piston and at least one piston rod, the piston having a primary effective surface and a secondary effective surface. The secondary chamber of the slave cylinder unit forms a tank and is designed to contain a fluid. The circuit includes at least one master cylinder unit having a primary chamber, a secondary chamber, a piston having a primary effective surface and a secondary effective surface and at least a piston rod, a pump for sucking the fluid from the tank, a first conduit to operatively connects that tank to the primary chamber of the master cylinder unit via the pump, and a second conduit for operatively connecting a secondary chamber of the master cylinder unit to the primary chamber of the slave cylinder unit. The master cylinder unit and the slave cylinder unit are connectable to be single-acting. The secondary effective surface of the master cylinder unit and the primary effective surface of the slave cylinder unit are substantially equal.

It is therefore an object of the present invention to provide a hydraulic synchronizing circuit having a comparatively simple construction.

Another object of the present invention is to provide a hydraulic synchronizing circuit that does not require a separate tank.

Another object of the present invention is to provide a hydraulic synchronizing circuit that requires a comparatively small auxiliary tank.

Still another object of the present invention is to provide a slave cylinder unit for a hydraulic synchronizing circuit that has a comparatively simple construction.

Other objects, features and advantages of the present invention will become apparent to one with skill in the art upon examination of the following drawings and detailed description. It is intended that all such additional objects, features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
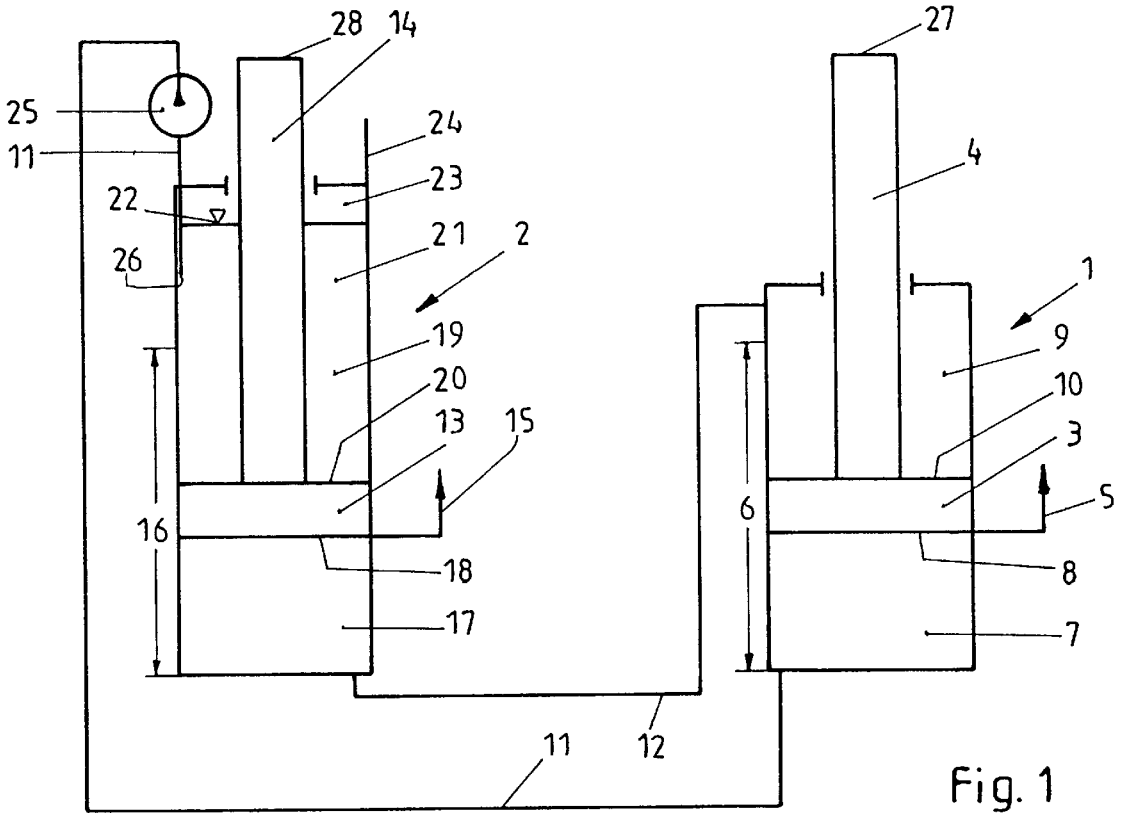
FIG. 1 is a schematic illustration of a first embodiment of the hydraulic synchronizing circuit including a master cylinder unit and a slave cylinder unit.

Referring now in greater detail to the drawings, FIG. 1 illustrates all essential elements of the hydraulic synchronizing circuit according to the present invention. A master cylinder unit 1 and a slave cylinder unit 2 are illustrated. The master cylinder unit 1 includes a piston 3 and a piston rod 4 which sealingly extends outside the housing of the master cylinder unit 1 in a known manner. The piston 3 travels and has a stroke 5 dependent from an activation. The maximum stroke 6 of the master cylinder 1 is limited by the length of its housing in combination with the width of its piston 3. It is also possible not to use the entire length of the master cylinder unit 1, and to provide a device for limiting the stroke (not shown). The piston 3 limits a primary chamber 7 with an effective surface 8 in the master cylinder unit 1. A secondary chamber 9 with an effective surface 10 is formed on the other side of the piston 3. It is clear that the effective surface 8 of the primary chamber 7 is greater than the effective surface 10 of the secondary chamber 9. The difference between the effective surface 8 and the effective surface 9 corresponds to the diameter of the piston rod 4. A first conduit 11 is connected to the primary chamber 7 of the master cylinder unit 1. A second conduit 12 is connected to the secondary chamber 9 of the master cylinder unit 1.

The slave cylinder unit 2 also includes a piston 13 having a piston rod 14. The piston rod 14 is operatively arranged on the same side as the piston rod 4 at the master cylinder unit 1. In case of an activation, the piston 13 travels through a stroke 15 the same way as the piston 3 of the master cylinder unit 1 travels through the stroke 5. The piston 13 may travel through an entire stroke 16. The entire stroke 16 of the, slave cylinder unit 2 corresponds to the entire stroke 6 of the master cylinder unit 1. The master cylinder unit 1 determines the entire stroke 16 of the slave cylinder unit 2. The slave cylinder unit 2 also includes a primary chamber 17. The piston 13 forms an effective surface 18 on this side. The piston 13 limits a secondary chamber 19 with an effective surface 20 on the other side. The effective surfaces 18 and 20 also differ by the diameter or the surface of the piston rod 14. As illustrated in FIG. 1, the piston rods 4 and 14 may have the same diameter. The second conduit 12 is connected to the primary chamber 17 of the slave cylinder unit 2. The effective surface 10 in the secondary chamber 9 of the master cylinder unit 1 has the same size as the effective surface 18 in the primary chamber 17 of the slave cylinder unit 2. This is the requirement for equal strokes 5 and 15, respectively, of the two pistons 3 and 13 in case of an activation of the strokes 5 and 15 by a movement of the column of the hydraulic medium from the secondary chamber 9 of the master cylinder unit 1 into the primary chambers 17 of the slave cylinder unit 2. It is important to realize that the diameter of the slave cylinder unit 2 and of the piston 13, respectively, is smaller than the diameter of the master cylinder unit 1 and of the piston 3, respectively, to provide equal effective surfaces 10 and 18. This can be seen from FIG. 1, although the difference in diameters is very small and therefore is hard to realize without using a ruler.

As illustrated in FIG. 1, the slave cylinder unit 2 is a little bit longer than the master cylinder unit 1. In this way, the secondary chamber 19 of the slave cylinder unit 2 is enlarged. The enlarging part of the secondary chamber 19 is formed as a tank 21 for hydraulic medium or for a fluid. The secondary chamber 19 and the tank 21 are filled with the hydraulic medium up to a schematically illustrated level 22. The chamber 23 above the level 22 is connected to the atmosphere by a venting device 24. A pump 25 is arranged in the conduit 11. The conduit 11 leads to the secondary chamber 19 and to the tank 21, respectively, and ends outside the stroke 15 of the piston 13 in a suction pipe 26 for the pump 25. The end of the suction pipe 26 is arranged to be always below the level 22, so that the pump 25 exclusively sucks in hydraulic medium, instead of air.

An activation of the pump 25 results in the fluid being sucked in from the tank 21 and from the primary chamber 19 of the slave cylinder unit 2, respectively, and being sent to the master cylinder unit 1 via the primary chamber 7. It is assumed that the starting point of the master cylinder unit 1 and of the slave cylinder unit 2 is in a position that means that the piston rods 4 and 14 extend minimally. Consequently, the pistons 3 and 13 are located at the lower ends of the cylinder units 1 and 2. This is a position in which the level 22 of the fluid inside the tank 21 is raised to its maximum position. This means that the fluid volume including an auxiliary or safety volume is located relatively close to the bottom of the slave cylinder unit 2 in the region of the piston rod 14. According to the illustrated design of the master cylinder unit 1 and of the slave cylinder unit 2 including all elements, the level 22 inside the slave cylinder unit 2 falls in case of rising strokes 5 and 15, respectively. The height of the tank 21 and the extension of the suction tub 26 have to be determined in a way that the level 22 does not fall below the lower end of the suction tube 26 in case of travelling through an entire stroke 16. The following calculation makes it clear that in case of this pushing arrangement of the master cylinder unit 1 and of the slave cylinder unit 2 according to FIG. 1, the level 22 inside the tank 21 falls or sinks when the stroke 5 and 15, respectively, rises or goes up:

The cross-sectional area 27 of the piston rod 4 results from the difference between the effective surfaces 8 and 10. This means:

$$|27|=|8|-|10|.$$

The cross-sectional area 28 of the piston rod 14 of the slave cylinder unit 2 results from the difference of the effective surfaces 18 and 20. This means:

$$|28|=|18-|20|.$$

These two equations can be transformed as follows:

$$|8|=|27|+|10|$$

$$|20|=|18|-|28|.$$

The difference between the effective surface 20 of the secondary chamber 19 of the slave cylinder unit 2 and the effective surface 8 of the primary chamber 7 of the master cylinder unit 1 equals as follows:

$$|20|-|8|=|18|-|28|-(|27|+|10|).$$

The effective surface 10 of the master cylinder unit 1 and the effective surface 18 of the slave cylinder unit 20 have the same size:

$$|10|=|18|,$$

so that the following equation results:

$$|20|-|8|=-|28|-|27|.$$

When the cross-sectional area 27 and the cross-sectional area 28 have the same size, this difference is twice as great as the cross-sectional area 27 and 28, respectively.

Observing the moved volumes in case of an activation of the pump 25 and a stroke 15 and 5, respectively, the difference volume results as the product of the change of the difference of the effective surfaces and the stroke. The difference volume DV is:

$$DV=|15|*(|20|-|8|)=-|28|-|27|.$$

The amount of the difference volume DV is twice as great as the moved or displaced volume of the piston rod. The negative digit sign indicates that the level 22 falls or sinks when the stroke rises or goes up.

An activation of the pump 25 in its other sense of rotation, and, consequently, in its other conveying direction, results in the fluid being sucked in from the primary chamber 7 of the master cylinder unit 1 into the tank 21 of the slave cylinder unit 2. Consequently, the volume of fluid being located inside the primary chamber 7 is reduced, and the piston 3 of the master cylinder unit 1 moves in a downward direction to its retracted position. As the same time, the volume of the secondary chamber 9 of the master cylinder unit 1 is increased, and fluid is sucked in from the primary chamber 17 of the slave cylinder unit 2. Consequently, the volume of fluid being located inside the primary chamber 17 is reduced, and the piston 13 of the slave cylinder unit 2 also moves in a downward direction to its retracted position.

Figure 2:
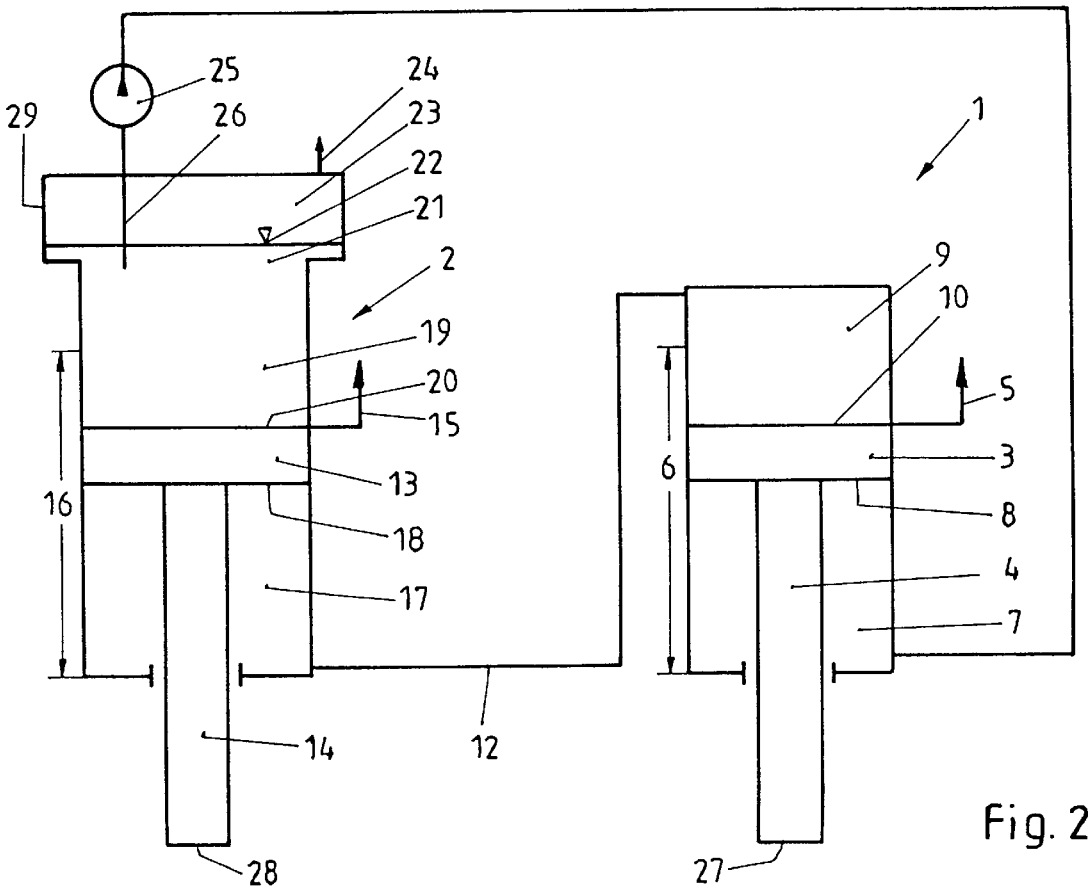
FIG. 2 illustrates a second embodiment of the hydraulic synchronizing circuit with a pulling arrangement of the cylinders.

In case of a pulling arrangement, as it is for example illustrated in FIG. 2, the digit sign or preceding sign changes. The minus becomes a plus. This means that in case of a pulling arrangement of the piston rods 4 and 14, there is an opposite relation: the level 22 in the tank 21 rises or goes up when the stroke 15 rises. The calculation for this relation is similar to the above mentioned calculation.

The embodiment of FIG. 2 is mostly similar to the embodiment illustrated in FIG. 1 concerning reference numerals. A pulling arrangement is illustrated, i. e. the piston rods 4 and 14 are located on the other side of their piston 3 and 13. Since this embodiment also illustrates a synchronizing circuit meaning that the synchronizing requirement of the amount of the effective surfaces 10 and 18 being identical has to be met $$|10|=|18|,$$

the diameter of the slave cylinder unit 2 has to be slightly bigger than the diameter of the master cylinder unit 1. The maximum strokes 6 and 16 of the master cylinder unit 1 and of the slave cylinder unit 2 are also determined by the length of the master cylinder unit 1. In this embodiment, the tank 21 has a diameter different from the diameter of the slave cylinder unit 2.

A step 29 is formed outside the maximum stroke 16. The diameter of the step 29 is greater than the diameter of the slave cylinder unit 2. The chamber 23 above the level 21 has dimensions so that the tank 21 can contain the difference volume of the hydraulic medium or fluid located between the primary chamber 7 of the master cylinder unit 1 and the secondary chamber 19 of the slave cylinder unit 2 when the piston 14 travels along the entire stroke 16.

Figure 3:
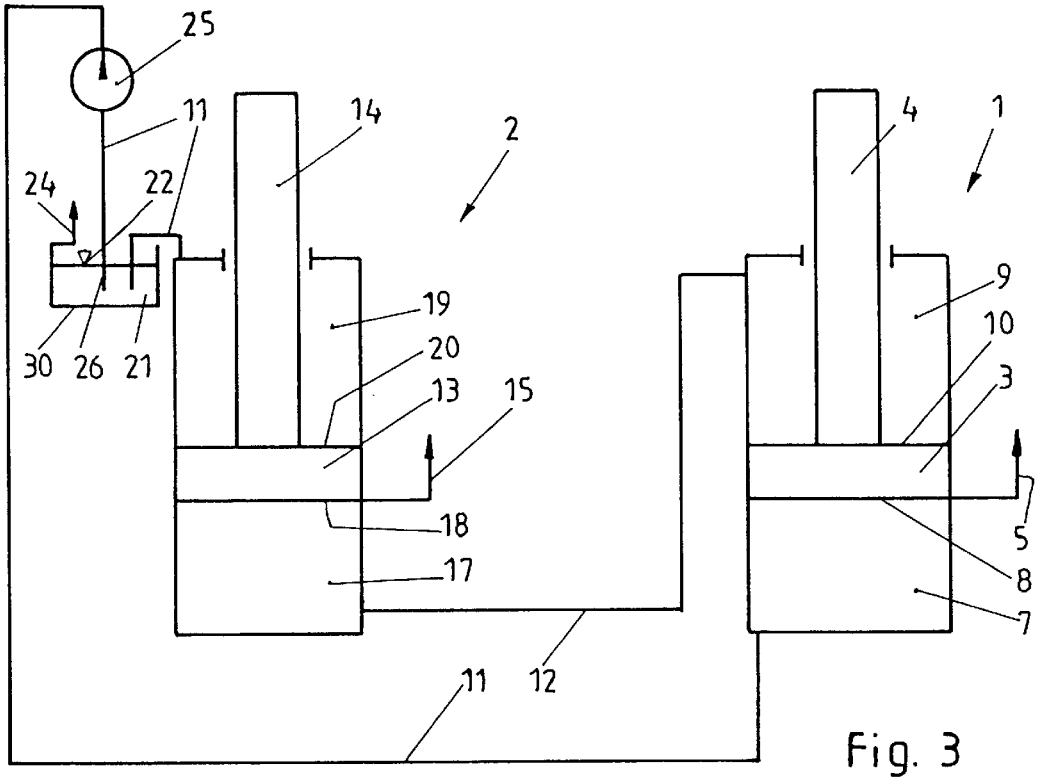
FIG. 3 illustrates a third embodiment of the hydraulic synchronizing unit having a pushing arrangement of their cylinders and using an auxiliary tank.

The embodiment of the hydraulic synchronizing circuit and of the master cylinder unit 1 and the slave cylinder unit 2, respectively, as illustrated in FIG. 3 has a lot of parts or elements in common with the embodiment illustrated in FIG. 1. The slave cylinder unit 2 may be as long as the master cylinder unit 1. It is also possible to design the slave cylinder unit 2 to be longer, as it is shown in FIG. 1, or to provide a step as illustrated in FIG. 2. According to the embodiment illustrated in FIG. 3, the auxiliary tank 30 has to have such a volume so that the auxiliary tank 30 is able to contain at least the difference volume. Thus, the auxiliary tank 30 can be designed a lot smaller than the tank arranged at the same position in the prior art. Additionally, the tank in the prior art is not connected to the secondary chamber of the slave cylinder unit 2. As illustrated in FIG. 3, the venting device 24 is arranged at the auxiliary tank 30.

Figure 4:
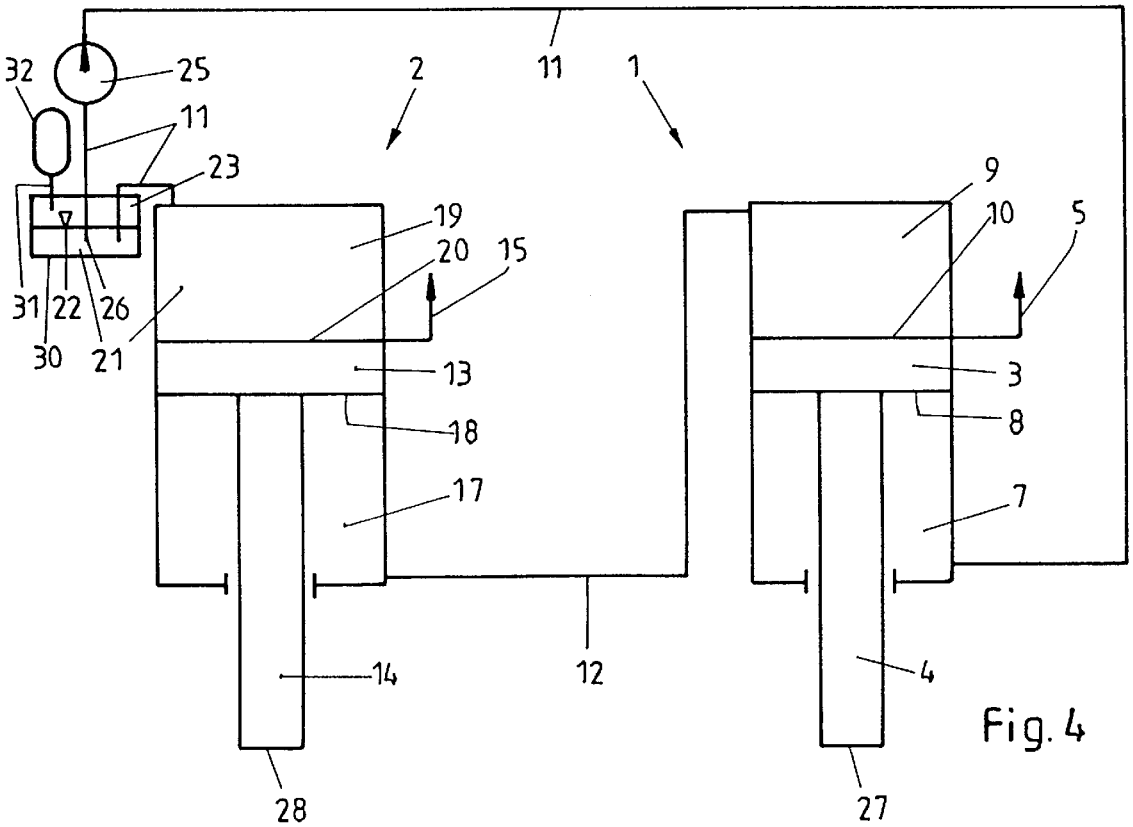
FIG. 4 illustrates another embodiment of the hydraulic synchronizing circuit.

FIG. 4 illustrates an embodiment of the synchronizing circuit having a pulling arrangement of the piston rods 4 and 14. The auxiliary tank 30 has a relatively small volume and relatively small dimensions. The auxiliary tank 30 serves to contain the difference volume. The auxiliary tank 30 is connected to the secondary chamber 19 of the slave cylinder unit 2 by a conduit 11, so that the tank 21 is partly realized or formed inside the secondary chamber 19 and partly inside the auxiliary tank 13. In this embodiment, the auxiliary tank 30 is closed. A conduit 31 leads from the auxiliary tank 30 to a reservoir 32 permanently connected to the chamber 23 above the level 22. The reservoir 32 is filled with a compressed gas, for example air, so that the synchronizing circuit is kept under a predetermined pressure.

Figure 5:
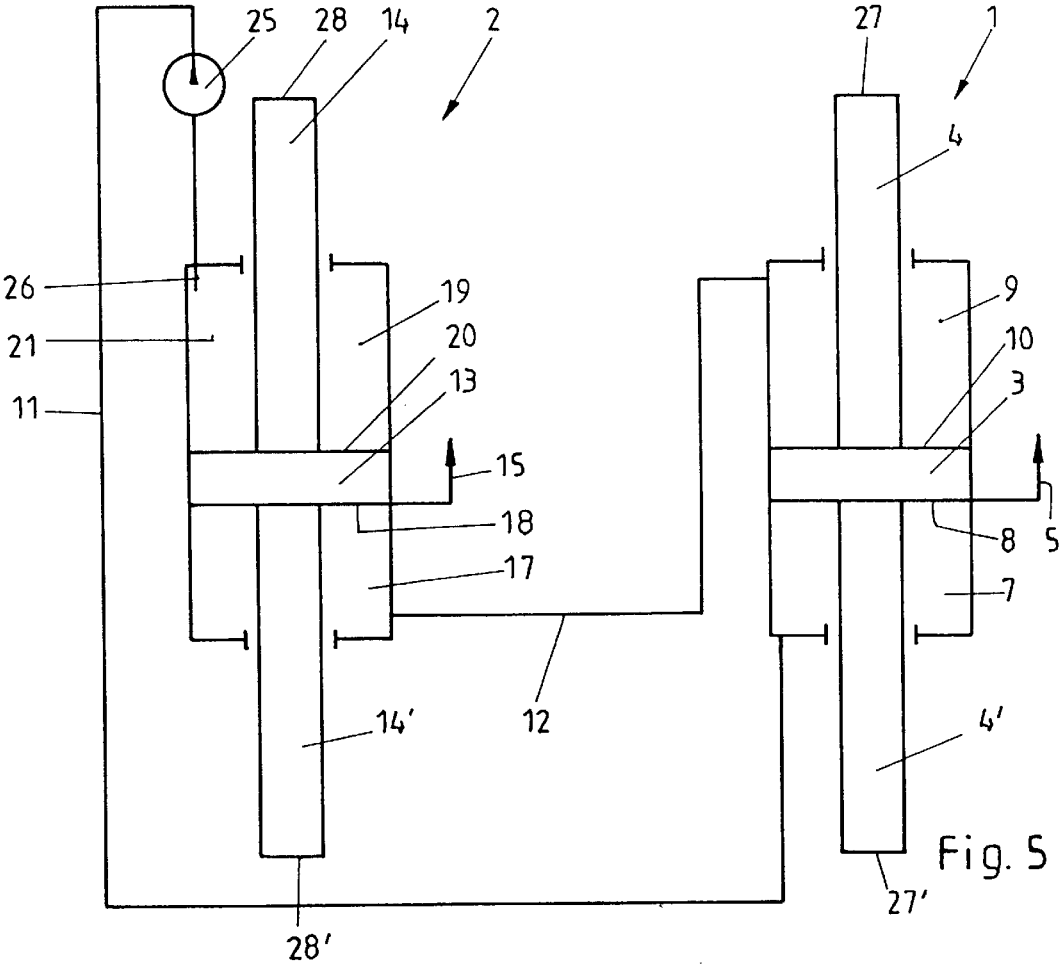
FIG. 5 illustrates another embodiment of the hydraulic synchronizing circuit using cylinders having the same stroke.

FIG. 5 illustrates another embodiment of the synchronizing circuit. The master cylinder unit 1 and the slave cylinder unit 2 are designed identically. Piston rods 4, 4', 14, 14' having approximately identical diameters are arranged on both sides of the piston 3 and 13, respectively. The cylinders also have the same length and diameter. The conduit 11 connects the secondary chamber 19 of the slave cylinder unit 2 to the primary chambers 7 of the master cylinder unit 1. The tank 21 is formed or located inside the secondary chamber 19 of the slave cylinder unit 2. In case of an activation, the same volume of hydraulic medium or fluid is moved during the same unit of time through the two conduits 11 and 12. Consequently, the pistons 3 and 13 travel along identical strokes 5 and 15.

Figure 6:
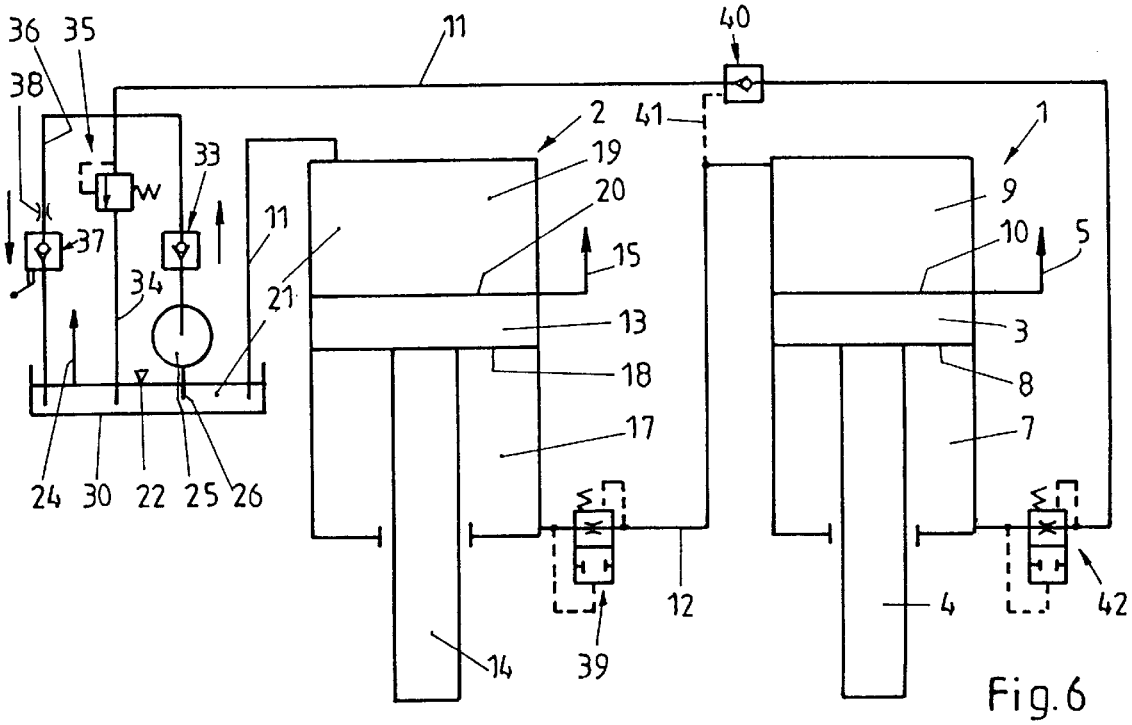
FIG. 6 illustrates an embodiment similar to FIG. 4, additionally showing the valves of the hydraulic synchronizing circuit.

The embodiment of the synchronizing circuit as illustrated in FIG. 6 is similar to the embodiment illustrated in FIG. 4. The tank 21 is partly located inside the secondary chamber 19 of the slave cylinder unit 2 and partly inside the auxiliary tank 30. The auxiliary tank 30 includes the venting device 24. Additionally, some circuit elements are illustrated. The pump 25 with its suction pipe 26 sucks in the hydraulic medium from the auxiliary tank 30 below the level 22. Then, the pump 25 pumps the fluid into a conduit 11 via a check valve 33. A pressure control valve 35 is located in a return conduit 34. The pressure control valve 35 serves as a safety valve. The pressure control valve 35 opens when the pump 25 is not supposed to pump in case of an unwanted high pressure. Consequently, overstressing of the pump 25 and of all other hydraulic or mechanical elements is prevented. A hand actuated highlight controlled check valve 37 is arranged in another parallel conduit 36. A throttle 38 may be arranged above the check valve 37. The check valve 37 can be manually activated, for example, to release hydraulic medium from the primary chamber 7 of the master cylinder unit 1 into the auxiliary tank 30. FIG. 6 illustrates the circuit for a hydraulic car lift or autohoist as it is commonly used in garages. The check valve 37 makes it possible to manually lower the car lift or autohoist. A safety valve 39 for preventing a pipe break is arranged in the conduit 12. The safety valve 39 is preferably located close to the primary chamber 17 of the slave cylinder unit 2 so that the conduit 12 substantially extends between the safety valve 39 and the secondary chamber 9 of thus master cylinder unit 1. The safety valve 39 for preventing pipe break has two positions, a throttling position and a closing position. The safety valve 37 usually is held in its throttling position, it can also be controlled downstream and upstream by its pressure. In case of leakage in the conduit 12, the pressure in the conduit 12 falls rapidly, and the pressure inside the primary chamber 17 of the slave cylinder unit 2 controls the valve to change into its closing position, so that the fluid inside the primary chamber 17 of the slave cylinder unit 2 is locked-in, and the slave cylinder unit 2 can not be lowered into its starting position by its load. Additionally, the master cylinder unit also cannot be lowered in case of leakage in the conduit 12. A hydraulic pilot check valve 40 is therefore located in the conduit 11. The check valve 40 is controlled via a control conduit 41 (illustrated by a dashed line). The control conduit 41 is connected to the conduit 12. The occurring pressure keeps the check valve 40 in its open position. When the pressure disappears, as in case of a leakage in the conduit 12, the check valve 40 closes, so that the fluid inside the primary chamber 7 of the master cylinder unit 1 is caught or blanked off.

Another safety valve 42 for preventing pipe break is arranged preferably close to the primary chamber 7 of the master cylinder unit 1. The safety valve 42 may have the same design and arrangement as the safety valve 32 for preventing pipe break. It may also have a similar function concerning a possibly occurring leakage in the section of the conduit 12 between the safety valve 42 for preventing pipe break and the hydraulic pilot check valve 40.

Figure 7:
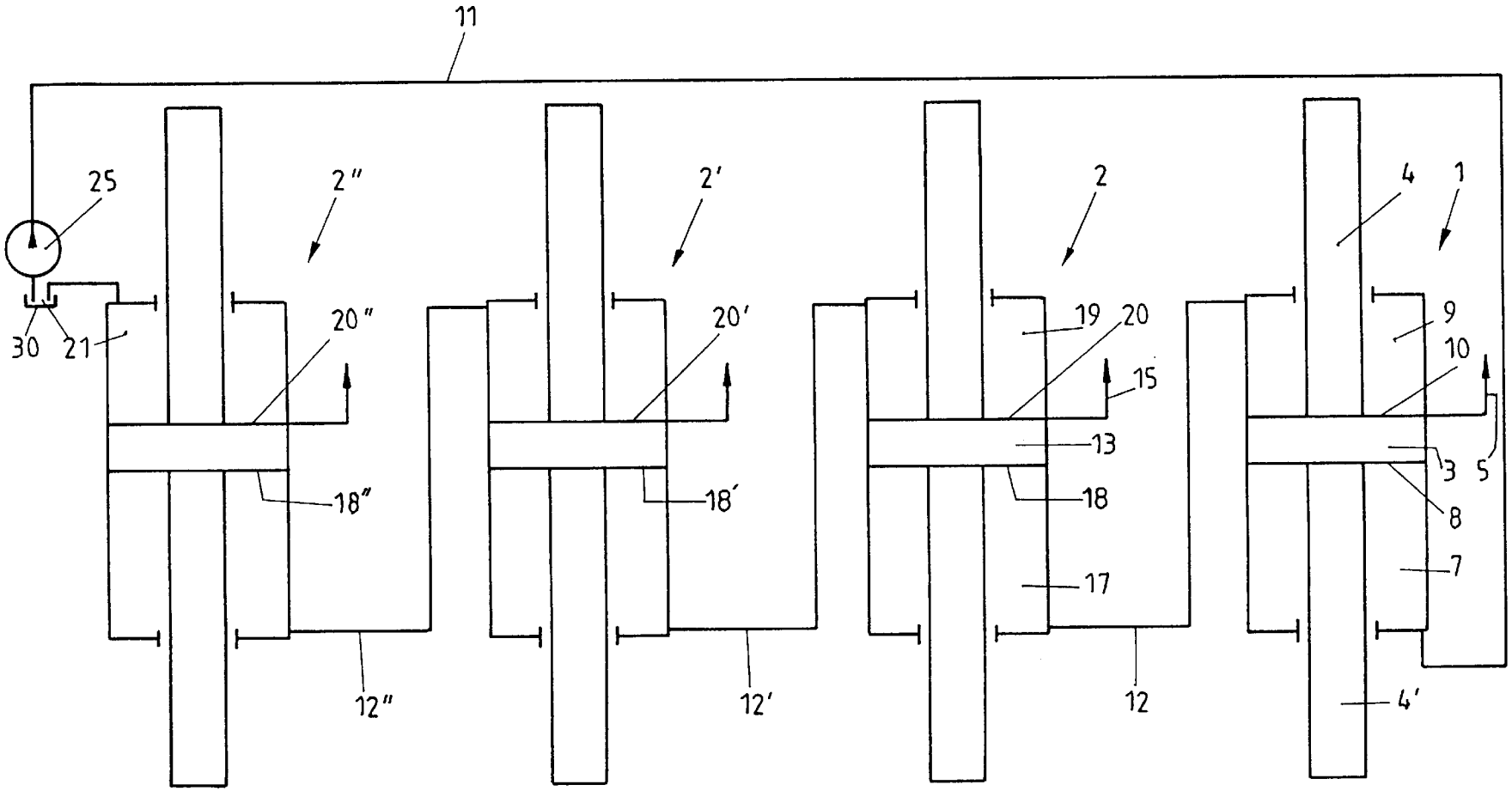
FIG. 7 illustrates another embodiment of the hydraulic synchronizing circuit including one master cylinder unit and three slave cylinder units.

The synchronizing circuit includes at least one master cylinder unit 1 and at least one slave cylinder unit 2. FIG. 7 shows an embodiment in which three slave cylinder unit 2, 2', 2" are arranged after one master cylinder unit 1. All cylinders 1, 2, 2', 2" are each designed as synchronizing cylinders having two identical rods and the same design in general. The tank 21 is partly located inside a secondary chamber of the slave cylinder unit 2" and partly inside the auxiliary tank 30. All effective surface 8, 10, 18, 20, 18', 20', 18", 20" have the same size. It is easily imaginable that the number of slave cylinders 2, 2' and so on can be varied without departing from the spirit of the synchronizing circuit according to the present invention.

Many variations and modifications may be made to the preferred embodiments of the invention without departing substantially from the spirit and principles of the invention. All such modifications and variations are intended to be included herein within the scope of the present invention, as defined by the following claims.

I claim:

1. A hydraulic synchronizing circuit, comprising:

at least one master cylinder unit including a primary chamber, a secondary chamber, a piston and at least one piston rod, said piston having a primary effective surface and a secondary effective surface;

at least one slave cylinder unit including a primary chamber, a secondary chamber, a piston and at least one piston rod, said piston having a primary effective surface and a secondary effective surface;

wherein said master cylinder unit and said slave cylinder unit are arranged to be single-acting;

wherein said secondary effective surface of said master cylinder unit and said primary effective surface of said slave cylinder unit are substantially equal;

a tank at least partially being formed by said secondary chamber of said slave cylinder unit and containing a fluid;

a pump sucking the fluid from said tank;

a first conduit operatively connecting said tank to said primary chamber of said master cylinder unit via said pump; and a second conduit operatively connecting said secondary chamber of said master cylinder unit to said primary chamber of said slave cylinder unit.

2. The hydraulic synchronizing circuit of claim 1, wherein said tank is designed and arranged to contain at least a volume necessary for a complete stroke of said piston of said master cylinder unit, and additionally a difference volume of the complete stroke of said piston and a difference between said secondary effective surface of said slave cylinder unit and said primary effective surface of said master cylinder unit.

3. The hydraulic synchronizing circuit of claim 1, wherein said slave cylinder unit has a greater length than said master cylinder unit.

4. The hydraulic synchronizing circuit of claim 1, wherein said secondary chamber of said slave cylinder unit includes a step having a greater diameter than said slave cylinder unit.

5. The hydraulic synchronizing circuit of claim 1, further comprising an auxiliary tank arranged in said first conduit and between said tank formed by said secondary chamber of said slave cylinder unit and said pump.

6. The hydraulic synchronizing circuit of claim 1, wherein said piston rod of said master cylinder unit is designed and arranged to extend through said secondary chamber of said master cylinder unit, and wherein said piston rod of said slave cylinder unit is designed and arranged to extend through said secondary chamber of said slave cylinder unit.

7. The hydraulic synchronizing circuit of claim 1, wherein said piston rod of said master cylinder unit is designed and arranged to extend through said primary chamber of said master cylinder unit, and wherein said piston rod of said slave cylinder unit is designed and arranged to extend through said primary chamber of said slave cylinder unit.

8. The hydraulic synchronizing circuit of claim 1, wherein said master cylinder unit and said slave cylinder unit each include two identical piston rods, and wherein said master cylinder unit and said slave cylinder unit are designed and arranged to have the same stroke.

9. The hydraulic synchronizing circuit of claim 1, wherein said secondary chamber of said slave cylinder unit forming said tank includes a venting device connected to the atmosphere.

10. The hydraulic synchronizing circuit of claim 1, wherein said secondary chamber of said slave cylinder unit forming said tank is connected to a reservoir containing a gas.

11. A slave cylinder unit for a hydraulic synchronizing circuit, said slave cylinder unit comprising:

a primary chamber, a secondary chamber, a piston and at least one piston rod, said piston having a primary effective surface and a secondary effective surface;

a tank formed by said secondary chamber and designed to contain a fluid;

wherein the circuit includes at least one master cylinder unit having a primary chamber, a secondary chamber, a piston having a primary effective surface and a secondary effective surface and at least one piston rod, a pump for sucking the fluid from said tank, a first conduit to operatively connect said tank to the primary chamber of the master cylinder unit via the pump, and a second conduit for operatively connecting the secondary chamber of the master cylinder unit to said primary chamber of said slave cylinder unit, wherein the master cylinder unit and said slave cylinder unit are connectable to be single-acting, and wherein the secondary effective surface of the master cylinder unit and said primary effective surface of said slave cylinder unit are substantially equal.

* * * * *